US005955732A

United States Patent [19]

Tsuno

[11] Patent Number: 5,955,732

[45] Date of Patent: Sep. 21, 1999

[54] OMEGA-TYPE ENERGY FILTER

[75] Inventor: Katsushige Tsuno, Tokyo, Japan

[73] Assignee: Jeol Ltd., Tokyo, Japan

[21] Appl. No.: 09/032,569

[22] Filed: Feb. 27, 1998

[30] Foreign Application Priority Data

Feb. 27, 1997 [JP] Japan ..... 9-043586

[51] Int. Cl.[6] ..... H01J 49/46

[52] U.S. Cl. ..... 250/305; 250/396 ML

[58] Field of Search ..... 250/305, 396 ML, 250/310, 311

[56] References Cited

U.S. PATENT DOCUMENTS 5,811,801 9/1998 Tsuno ..... 250/305

OTHER PUBLICATIONS

"High–Resolution imaging magnetic energy filters with simple structure", S. Lanio, *Optik*, 78, No. 3 (1986), pp. 99–107.

"Design of an omega filter for a 200 kv electron microscope", K. Tsuno and E. Munro, *Rev. Sci. Instrum.,* 68 (1), Jan. 1997, pp. 109–115.

*Primary Examiner*—Kiet T. Nguyen

*Attorney, Agent, or Firm*—Webb Ziesenheim Logsdon Orkin & Hanson, P.C.

[57] ABSTRACT

There is disclosed a small-sized omega-type energy filter having reduced drift lengths and an increased merit function. Four magnetic fields $M_1$, $M_2$, $M_3$, and $M_4$ deflect the electron beam into an Ω-shaped orbit from the entrance window plane to the slit plane. The distance $L_4$ from the exit end surface of the third field $M_3$ to the entrance end surface of the fourth field $M_4$ is set no greater than $50\sqrt{U^*}/\sqrt{U^*(200)}$ mm. The deflection angle Φ is set to a range of from 120°−50° to 120°+5°. The distance $L_3$ from the central plane between the second field $M_2$ and the third field $M_3$ to the entrance end surface of the third field $M_3$ is set such that $20\sqrt{U^*}/\sqrt{U^*(200)}$ mm $\geqq 10\sqrt{U^*}/\sqrt{U^*(200)}$ mm. The distance $L_5$ from the exit end surface of the fourth field $M_4$ to the slit plane is set such that $30\sqrt{U^*}/\sqrt{U^*(200)}$ mm $\leqq L_5 \leqq 50\sqrt{U^*}/\sqrt{U^*(200)}$ mm.

6 Claims, 9 Drawing Sheets

OMEGA-TYPE ENERGY FILTER

FIELD OF THE INVENTION

The present invention relates to an omega-type energy filter for deflecting an electron beam into an omega-like orbit by four magnetic fields from the entrance window to the exit window or a slit plane.

DESCRIPTION OF THE PRIOR ART

FIG. 1 is a diagram illustrating one example of the structure of an electron microscope having electron optics incorporating an omega-type energy filter. FIG. 2 is a diagram illustrating the geometry of an omega-type energy filter of type A. FIG. 3 is a diagram illustrating the geometry of an omega-type energy filter of type B. FIGS. 4A and 4B are diagrams illustrating the fundamental orbit in the omega-type energy filter of type A. FIGS. 5A and 5B are diagrams illustrating the fundamental orbit in the omega-type energy filter of type B. FIG. 6 is a diagram illustrating geometrical figures on a specimen plane, the relations between an image on a pupil plane and the shape of an electron beam on a slit plane, and so on.

This microscope having electron optics including the omega-type energy filter has an electron gun 11 producing an electron beam as shown in FIG. 1. The beam is directed at a specimen 14 through condenser lenses 12 and through an objective lens 13. An image of the specimen is projected onto a fluorescent screen 20 through an intermediate lens 15, an entrance window 16, an omega-type energy filter 17, a slit (exit window) 18 and a projector lens 19.

In this omega-type energy filter 17, four magnetic fields $M_1$, $M_2$, $M_3$, and $M_4$, where the beam has radii of curvature $R_1$, $R_2$, $R_3$, and $R_4$, respectively, are arranged to form an $\Omega$-shaped orbit. These four fields each have a deflection angle of $\Phi$. The electron beam is passed through these magnetic fields in turn such that the outgoing beam is aligned with the incident beam. FIG. 2 shows an example of the shape of the polepieces of the type A and an example of the electron orbit. FIG. 3 shows an example of the shape of the polepieces of the type B and an example of the electron orbit.

These two examples shown in FIGS. 2 and 3 are designed under different optical conditions. Let z by the direction of the optical axis of electrons. Let y be the direction of the magnetic fields. Let x be the direction parallel to a magnetic polepiece plane perpendicular to both directions z and y. In the geometry shown in FIG. 2, focusing takes place three times in the direction x parallel to the magnetic polepiece plane and also in the magnetic field direction y. This geometry is known as the type A. In the geometry shown in FIG. 3, focusing occurs three times in the direction x and twice in the magnetic field direction y. This geometry is known as the type B. Their difference in fundamental optics is seen from FIGS. 4A, 4B, 5A and 5B depicting the orbits in the types A and B, respectively. In these two figures, the optical axis is shown to be modified to a straight line.

The intermediate lens 15 is placed immediately before the filter so that the beam converges at a plane. This plane is referred to as the entrance window plane I. A plane which is placed immediately behind the filter and in which a slit is inserted is referred to as the slit plane S, or exit window plane. The filter starts with the entrance window plane I and terminates at the slit plane S. Let $x\gamma$ and $y\delta$ be orbits having a height of zero in these two planes, respectively. These orbits $x\gamma$ and $y\delta$ pass through the center of the optical axis in these two planes, respectively. Let $x\alpha$ and $y\beta$ be orbits having nonzero heights in these two planes, respectively. That is, these orbits $x\alpha$ and $y\beta$ do not pass through the center of the optical axis in these two planes, respectively. When the electron microscope is adjusted so that a diffraction pattern is projected onto these two planes, an image is focused on the fluorescent screen 20. A virtual image is created before the slit, i.e., closer to the center of the filter than the slit. A round lens, or the projector lens 19, placed behind the slit creates a real image projected on the fluorescent screen. The plane at which the virtual image is formed is referred to as the pupil plane. The virtual image on the pupil plane has achromatic nature and does not depend on the energy of the beam. On the other hand, in the slit plane, dispersion takes place according to the energy of the beam. Hence, the image has isochromatic nature.

To make some second-order aberrations zero and to reduce the remaining aberrations, the omega-type energy filter is so designed that the beam orbit is symmetrical with respect to the symmetrical plane between the second magnetic field $M_2$ and the third magnetic field $M_3$. Expressed by the eikonal method, five of the 18 second-order aberrations are zero and, therefore, the remaining 13 aberrations are nonzero. Let LL be the distance from the exit pupil plane to the slit plane. The instrument is adjusted, using the intermediate lens 15, so that the entrance pupil plane is located the distance LL from the entrance window plane.

Under these conditions, the types A and B differ as follows. With respect to type A, in the orbit in the direction y (i.e., the direction of the magnetic fields), the relations $y\beta=0$ and $y\delta'=0$ hold on the symmetrical plane as shown in FIGS. 4A and 4B. With respect to type B, the relations $y\beta'=0$ and $y\delta=0$ hold on the symmetrical plane as shown in FIGS. 5A and 5B. In these equations "'" indicates a differentiation with respect to z, or the direction of the optical axis of the electrons. In other words, "'" denotes the inclination of the orbit. The x-orbit is the same for both types and given by $x\alpha=0$ and $x\gamma'=0$ on the symmetrical plane.

If these conditions are selected, focusing of the $x\gamma$-orbit takes place three times for the type A as shown in FIGS. 4A and 4B. Also, focusing of the $y\delta$-orbit occurs three times. With respect to type B, however, focusing of the $x\gamma$-orbit takes place three times but focusing of the $y\delta$-orbit occurs only twice as shown in FIGS. 5A and 5B. This inverts the image. That is, a mirror image is created. It has been known for many years that these two kinds of omega-type energy filters exist. All the energy filters developed heretofore, excluding those developed by Applicant, are of type A, because type B produces greater second-order aberrations, as explained by Lanio in "High-Resolution Imaging Magnetic Energy Filters with Simple Structure", *Optik,* 73 (1986), pp. 99–107.

The omega-type energy filter shows symmetry with respect to the symmetrical plane. Because of this symmetry, the filter can cancel out the second-order aberrations almost completely on the exit pupil plane. Where the omega-type filter is employed, a great advantage to an imaging filter is obtained. That is, a distortionless image is readily obtained on the pupil plane without blurring the image.

Geometrical figures on a specimen image, the relation between an image on the pupil plane and the shape of the electron beam on the slit plane, and so on, are next described with reference to FIG. 6. In FIG. 6, A indicates some concentric figures drawn on the specimen plane. B indicates than an electron beam carrying information about the figure drawn on the specimen plane is brought to a focus on the objective back focal plane. C shows the beam projecting the focal point onto the entrance window plane through an intermediate lens, the focal point being located on the objective back focal plane. E indicates the images projected onto the entrance pupil plane by manipulating the intermediate lens as described above, the images being drawn on the specimen plane. Let $r_i$ be the radius of the largest one of the concentric circles of the images.

D indicates the geometrical relations among the size of the beam on the entrance window plane, the size of the image on the entrance pupil plane (having the radius $r_i$) and the distance LL between both planes.

F shows that the images on the entrance pupil plane are projected onto the exit pupil plane through the filter without modification. In A–F above, the images and beam are drawn with uniform magnification and uniform size to help understanding. Neither the images nor the beam is distorted up to this point. Also, almost no blurring is observed.

G shows the shape of the beam on reaching the slit plane after leaving the exit pupil plane. It can be seen that the beam is distorted into a triangular form. H is an enlargement of G and drawn corresponding to the concentric images on the pupil plane. This reveals that a more outer circular image (strictly an image showing the peripheries of a circle) in F appears shifted to the left in H.

In this way, on the slit plane, outer beams in the field of view appear shifted in the direction of dispersion of the beam, i.e., to the left, relative to the beams close to the center of the field of view due to coma-like aberrations. Therefore, if the slit width is not set large, a wide field of view is not imparted to the final microscope image. However, if the slit width is increased, energy differs between the center of the field of view and peripheral portions within the same field of view because the aberration compensation owing to the symmetry with respect to the symmetrical plane produces almost no effect on the slit plane. Accordingly, it is important to reduce the aberrations on the slit plane in optimizing the geometry of the omega-type energy filter.

FIG. 7 is a diagram illustrating the parameters used in designing the omega-type energy filter. FIGS. 8A and 8B are diagrams illustrating the dependence of the merit function M on the deflection angle Φ. FIGS. 9A, 9B and 9C illustrate the relation between the geometry of the filter and the deflection angle Φ.

It is assumed that aberrations $\Delta X_p$ and $\Delta Y_p$ take place on the exit pupil plane and that aberrations $\Delta X_s$ and $\Delta Y_s$ occur on the slit plane. The full size of the beam containing no aberrations on the slit plane subtends angles α and β. The full size of the image on the exit pupil plane subtends angles γ and δ. The magnitudes of the aberrations $\Delta X_p$, $\Delta Y_p$, $\Delta X_s$ and $\Delta Y_s$ depend on the aberration coefficients (Aαaα, . . . , Bαββ, Cαα,) and on the subtended angles α, β, γ and δ. It is to be noted that the size of the beam on the slit plane is assumed to contain no aberrations. Therefore, the beam is not an actual beam containing aberrations. In FIG. 6, D can be referred to as an illustration for the above descriptions. The angles α and γ are made in the x-direction, while the angles β and δ are made in the y-direction.

The size of the beam on the specimen plane is limited by the objective aperture. The beam reaching the entrance window is also limited by the magnification of the intermediate lens. Therefore, where the magnification of the intermediate lens is low, the size of the beam is about 5 μm at maximum. Where the intermediate lens is used with high magnification, the size is much smaller. Therefore, the angle that the full size of the beam on the entrance window plane subtends is sufficiently small. This beam reaches the exit pupil plane as it passes through the filter. However, on the slit plane, this beam is spread considerable due to the aberrations on the slit plane. Accordingly, we estimate the diameter of the beam on the entrance window plane to be approximately 5 μm and regard this as representing the size of the aberration-free beam on the slit plane. Assume that the distance LL is 100 mm. The angles α and β that the aberration-free beam passing through this slit subtends are $0.005/100=5\times10^{-5}$ rad. On the other hand, the angles γ and δ that the image on the pupil plane subtends are approximately $10^{-2}$ rad. Hence, they differ by a factor of 200.

The magnitude of an aberration is the product of its aberration coefficient and angle. As mentioned previously, the angles α and β differ considerably from the angles γ and δ. Therefore, only coefficients associated with the certain large angles γ and δ almost determine the magnitude of the aberration. Consequently, only the aberration $\Delta X_s$ appears conspicuously on the slit plane and can be approximated by $$\Delta Xhd\ s=(r_i^2/LL^2)\ (A\gamma\gamma\gamma+B\gamma\delta\delta/2)$$

where $r_i$ is the height of the image on the pupil plane of the filter, LL is the distance from the pupil plane to the slit plane, and Aγγγ and Bγδδ are aberration coefficients.

Where the dispersion D is great, energy can be selected without difficulty even if the beam is spread due to aberrations on the slit plane. A merit function given by $$M=D\ r_i^2/\Delta X_s$$

can be adopted as an index representing the performance of the filter. The merit function can also be given by $$M=(D\ LL^2)/(A\gamma\gamma\gamma+B\gamma\delta\delta/2)$$

As the merit function M increases, the effect of the aberrations on the slit surface decreases.

In FIG. 7, it is assumed that the beam shows a radius of curvature $R_3$ in the magnetic field $M_3$ close to the symmetrical plane. The entrance end surface has an angle $\theta_1$. The exit end surface has an angle $\theta_2$. The beam shows a radius of curvature of $R_4$ in the magnetic field $M_4$ close to the slit. The entrance end surface has an angle $\theta_3$. The exit end surface has an angle $\theta_4$. They have a deflection angle Φ. Let $L_3$ be the distance from the symmetrical plane to the entrance end surface of the magnetic field $M_3$ close to the symmetrical plane. This distance $L_3$ is referred to as the drift length. Let $L_4$ be the distance from the exit end surface of the magnetic field $M_3$ to the entrance end surface of the magnetic field $M_4$. Let $L_5$ be the distance from the exit end surface of the magnetic field $M_4$ close to the slit of the slit plane S. Let LL be the distance from the exit pupil plane to the slit plane.

In this case, parameters defining the geometry of the filter are generally seven parameters, i.e., the distances $L_3$, $L_4$, $L_5$, the radii of curvature $R_3$, $R_4$ of the magnetic fields, the deflection angle Φ and the distance LL. Although there exist four magnetic fields, degrees of freedom are given to only two magnetic fields because of the symmetry about the symmetrical plane. The values of the end surface angles $\theta_1$, $\theta_2$, $\theta_3$, and $\theta_4$ of the magnetic fields are automatically determined to obtain focusing and so we have no choice. Of these parameters, the distance LL is set according to external conditions and thus is not used for the optimization here.

Of these parameters, the radius of curvature $R_4$ is kept constant at 50 mm. The value of the merit function M with respect to the deflection angle Φ is found for various values of the radius of curvature $R_3$. The results are shown in FIG. 8A. The merit function is at maximum where Φ=110°. At this time, increasing the radius of curvature $R_3$ produces better results. However, outside this range, focusing is not achieved, or the dispersion D is excessively small. It has been suggested that the optimum range of the deflection angle Φ is from approximately 95° to 115°. FIG. 8A supports this.

FIG. 8B shows variations in the distance $L_4$ with varying the deflection angle Φ under the conditions shown in FIG. 8A. It can be seen that as the deflection angle Φ increases, the distance $L_4$ decreases. The dependence on the deflection angle shown in FIGS. 8A and 8B is found under the following conditions:

(1) $0 \leqq \theta_1, \theta_2, \theta_3, \theta_4 \leqq 45°$ (excluding negative values)

$$\text{dispersion } D \geq \sqrt{U^*} / \sqrt{U^*(200)}\ \mu\text{m/eV} \tag{2}$$

where U* is a relativistically modified accelerating voltage and U*(200) is a value obtained at 200 kV. The same concept applies to the following.

$$20\sqrt{U^*} / \sqrt{U^*(200)}\ \text{mm} \leq 2 \times L_3, L_4, L_5 \leq 200\sqrt{U^*} / \sqrt{U^*(200)}\ \text{mm} \tag{3}$$

The conditions (1) and (3) above arise from practical requirements. Simulation of the geometry shows that there is a possibility that a greater value of the merit function M can be obtained even if these conditions are excluded.

Three combinations are selected from FIGS. 8A and 8B. The filter geometries and center beam orbits under these conditions are shown in FIGS. 9A, 9B and 9C, respectively. It is observed that where the deflection angle Φ is small, the width of the filter perpendicular to the incident and outgoing beams is increased, as shown in FIG. 9A. Conversely, as the deflection angle Φ increases, this width decreases, as shown in FIG. 9C.

Inserting the filter into the microscope column increases the height of the electron microscope accordingly. If the height of the instrument is too large, it may not be introduced into an ordinary laboratory room, or the instrument may be more susceptible to vibrations from the floor. In this respect, the height (i.e., the length of the filter along the direction of travel of the beam) is made smallest where the deflection angle Φ is 110°. While the height has been discussed, if the lateral dimension of the filter increased, the balance of the weight of the microscope would be deteriorated and the instrument would be more affected by vibrations from the floor. Consequently, the lateral dimension is important, as well as the height.

The energy filter has been discussed thus far theoretically and by numerical simulation. However, we have found empirically that the condition (3) above, i.e., $$20\sqrt{U^*} / \sqrt{U^*(200)}\ \text{mm} \leq 2 \times L_3, L_4, L_5 \leq 200\sqrt{U^*} / \sqrt{U^*(200)}\ \text{mm} \tag{3}$$

is rather inappropriate. In particular, problems associated with actual fabrication of the instrument exist as described below.

$L_3$, $L_4$, and $L_5$ are the lengths of spaces where no filter exists and are known as drifts. The electron beam travels straight through these spaces. It is now assumed that the estimation of the deflection action of the beam deviates slightly from the correct value. The filter geometry is determined based on the calculated distribution of the magnetic fields set up by the filter. If this estimation involves an error, the angle of the beam going out of each magnetic field will deviate from the preset value. This deviation can be compensated by slightly shifting the position of the beam as it enters the filter. Accordingly, it is possible to make up the deviations occurring in the drifts connected to the entrance side of the magnetic field $M_1$ and to the exit side of the magnetic field $M_4$, respectively, by adjusting the position of the beam as it enters each drift. However, with respect to the space between the fields $M_1$ and $M_2$, the space between the fields $M_2$ and $M_3$ and the space between the fields $M_3$ and $M_4$, the deviations of the exit positions of the beam cannot be made up unless the magnetic fields can be adjusted independently. Of course, it is possible in principle to insert deflection coils in the spaces between the successive drifts or to introduce mechanisms capable of adjusting the positions of the magnetic fields independently. However, the introduction of these adjusting mechanisms complicates the filter excessively, and yet does not effectively improve the final performance.

SUMMARY OF THE INVENTION

The present invention is intended to solve the foregoing problems. It is an object of the present invention to provide an omega-type energy filter which has reduced drift lengths and thus the filter is made smaller and which exhibits a greater merit function by reducing the deviations from calculated conditions.

This object is achieved in accordance with the teachings of the invention by an omega-type energy filter having a first magnetic field $M_1$, a second magnetic field $M_2$, a third magnetic field $M_3$, and a fourth magnetic field $M_4$ to deflect an electron beam into an Ω-shaped orbit from an entrance window plane to a slit plane. This filter is characterized in that the distance $L_4$ from the exit end surface of the third field $M_3$ to the entrance end surface of the fourth field $M_4$ is set no greater than $50\ \sqrt{U^*}/\sqrt{U^*(200)}$ mm, and that the deflection angle Φ is set to a range of from 120°−5° to 120°+5°.

In one feature of the invention, the distance $L_3$ from the symmetrical plane between the second magnetic field $M_2$ and the third magnetic field $M_3$ to the entrance end surface of the third field $M_3$ is given by $$20\sqrt{U^*} / \sqrt{U^*(200)}\ \text{mm} \geq L_3 \geq 10\sqrt{U^*} / \sqrt{U^*(200)}\ \text{mm}$$

In another feature of the invention, the distance $L_5$ from the exit end surface of the fourth magnetic field $M_4$ to the slit plane is given by $$30\sqrt{U^*} / \sqrt{U^*(200)}\ \text{mm} \geq L_5 \geq 50\sqrt{U^*} / \sqrt{U^*(200)}\ \text{mm}$$

Other objects and features of the invention will appear in the course of the description thereof which follows.

DETAILED DESCRIPTION OF THE INVENTION

Figure 10:
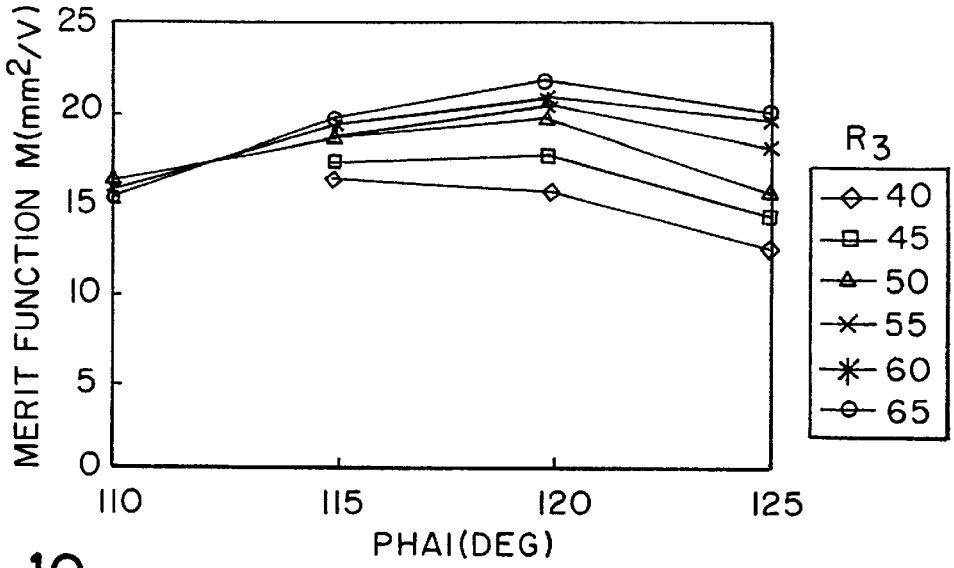
FIG. 10 is a diagram illustrating an omega-type energy filter in accordance with present invention.
Figure 11A:
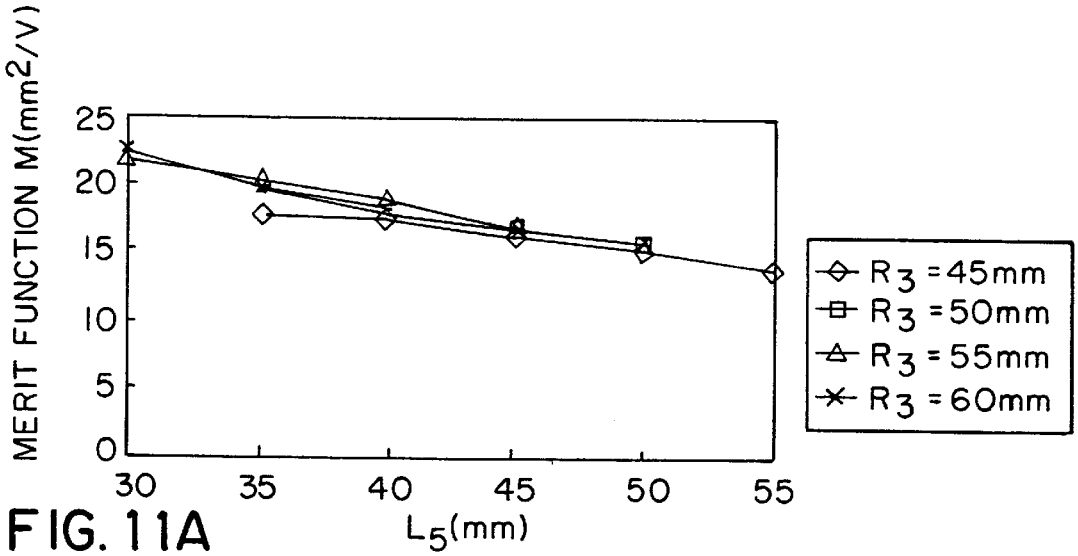
FIGS. 11A and 11B are diagrams illustrating the relation a the distance $L_5$ from the exit end surface of the fourth magnetic field of the energy filter shown in FIG. 10 to the slit plane, the merit function M and the dispersion D.
Figure 11B:
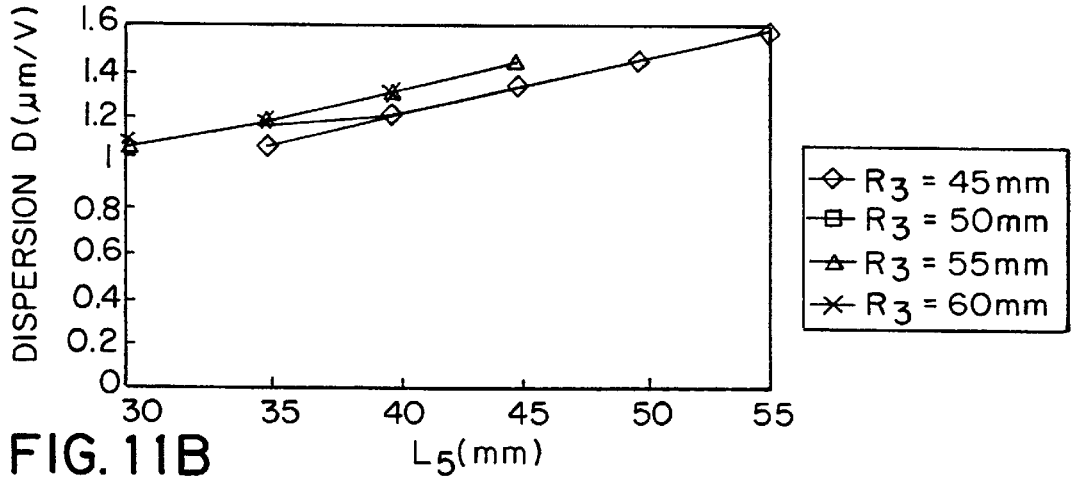

FIG. 10 illustrates an omega-type energy filter in accordance with the present invention. FIGS. 11A and 11B illustrate the relation among the distance $L_5$ from the exit end surface of the fourth magnetic field of this filter to the slit plane, the merit function M and the dispersion D.

Figure 1:
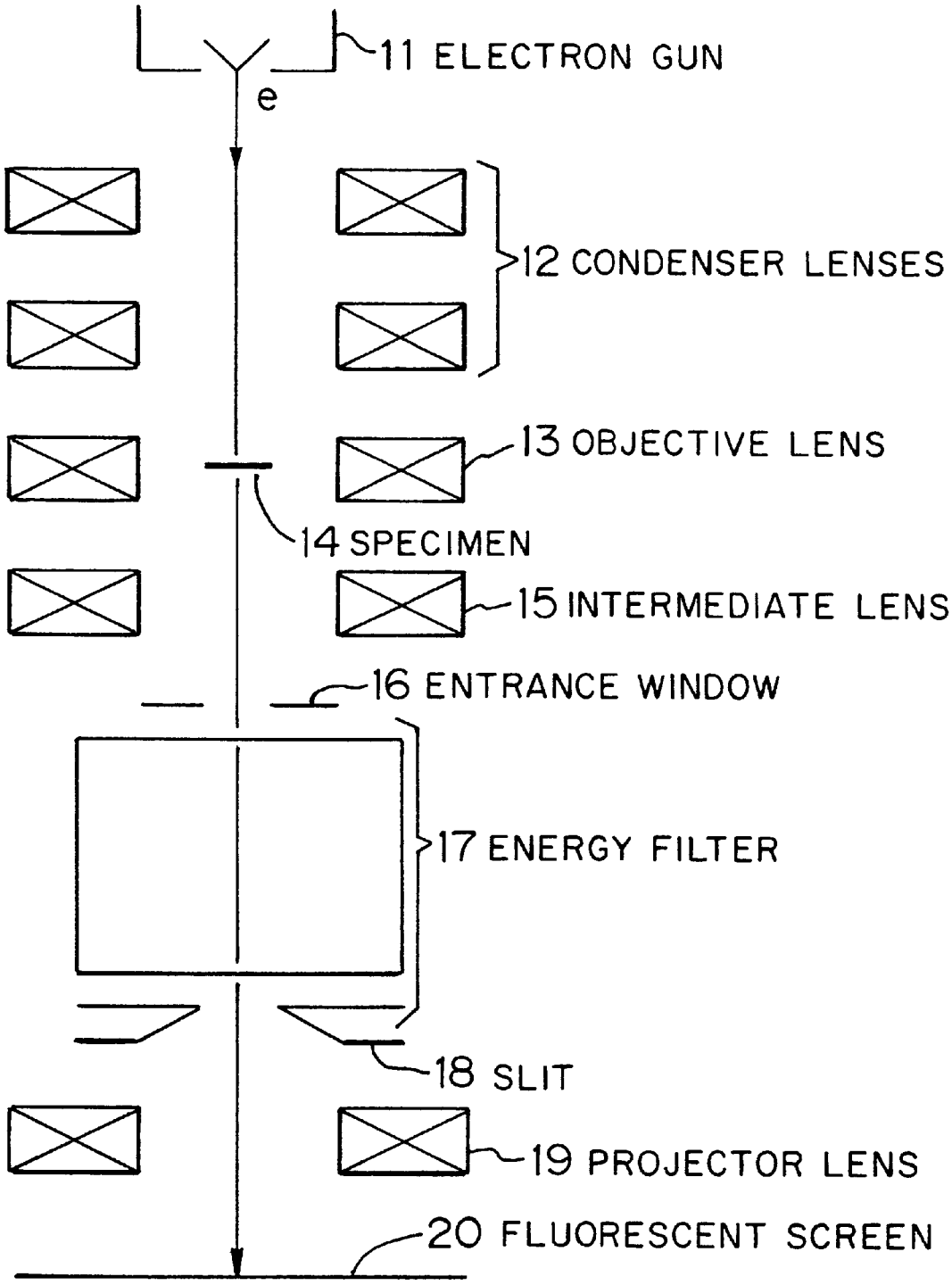
FIG. 1 PRIOR ART
FIG. 1 a diagram of an electron microscope having electron optics incorporating an omega-type energy filter.
Figure 3:
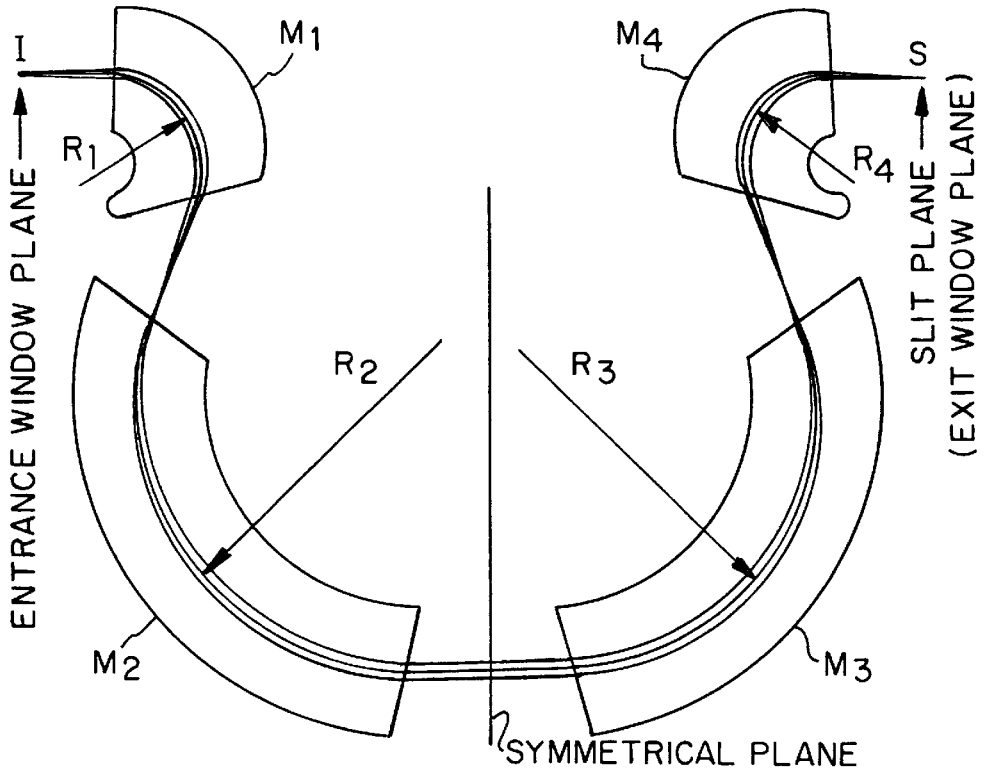
FIG. 3 PRIOR ART
FIG. 3 is a diagram illustrating the geometry of an omega-type energy filter of type B.
Figure 2:
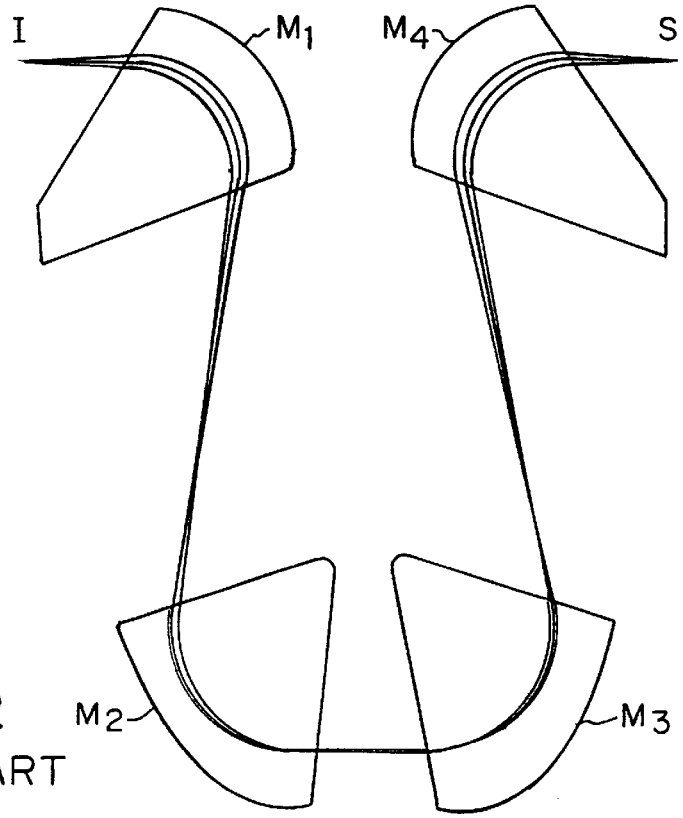
FIG. 2 PRIOR ART
FIG. 2 is a diagram illustrating the geometry of an omega-type energy filter of type A.
Figures 4A, 4B:
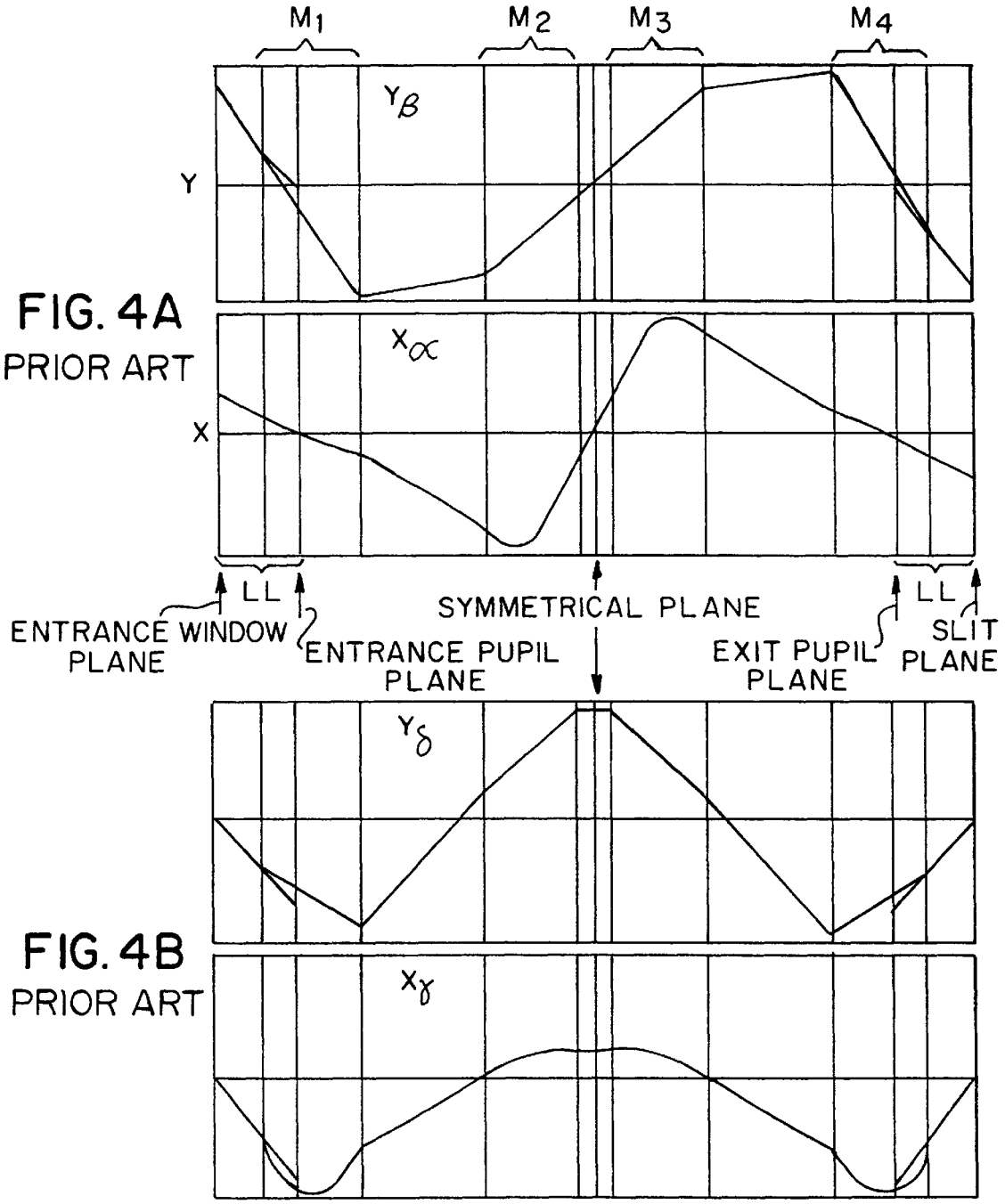
FIG. 4A PRIOR ART
FIG. 4B PRIOR ART
FIGS. 4A and 4B are diagrams illustrating the fundamental orbit of the omega-type energy filter of type A shown in FIG. 2.
Figures 5A, 5B:
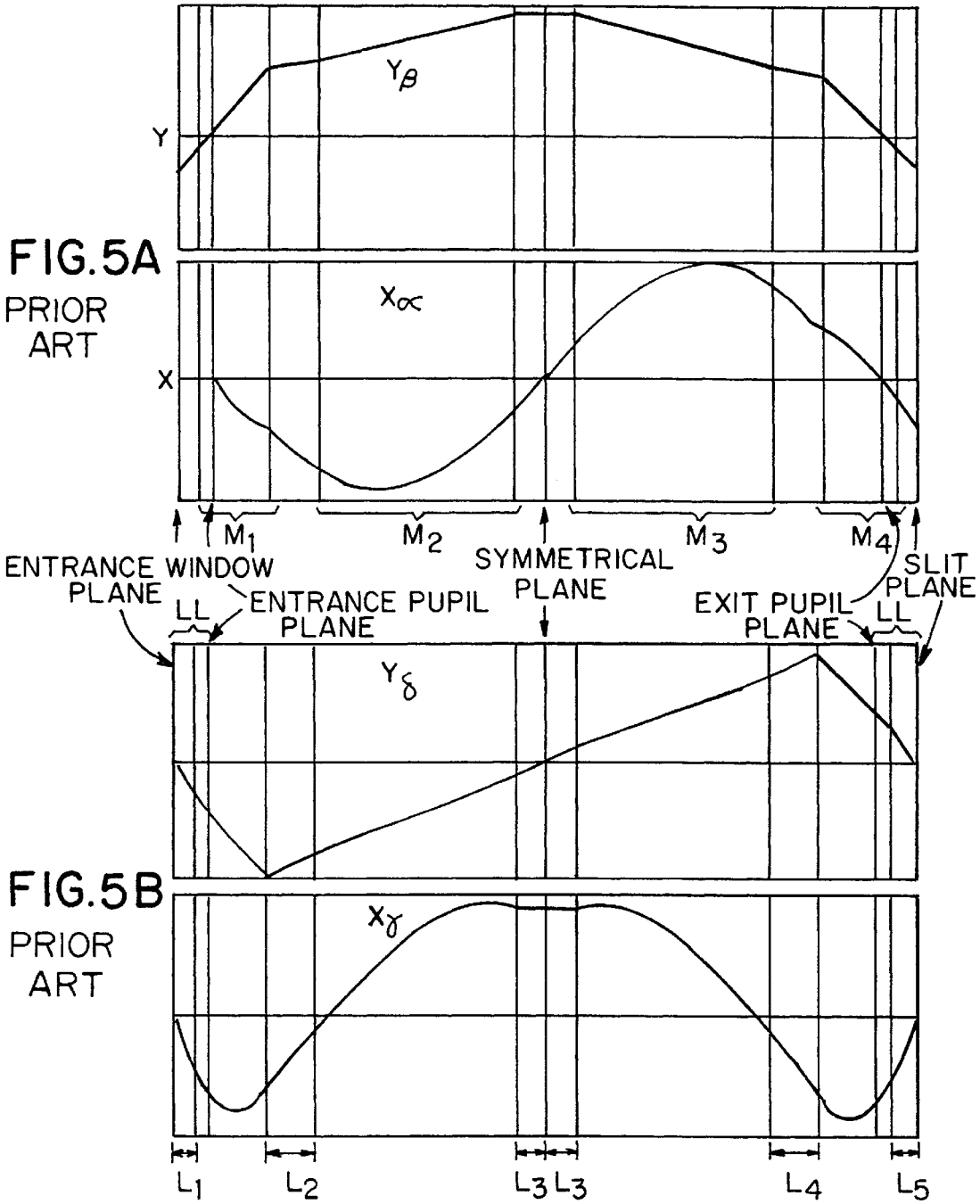
FIG.5A PRIOR ART
FIG.5B PRIOR ART
FIGS. 5A and 5B are diagrams illustrating the fundamental orbit of the omega-type energy filter of type B shown in FIG. 3.
Figure 6:
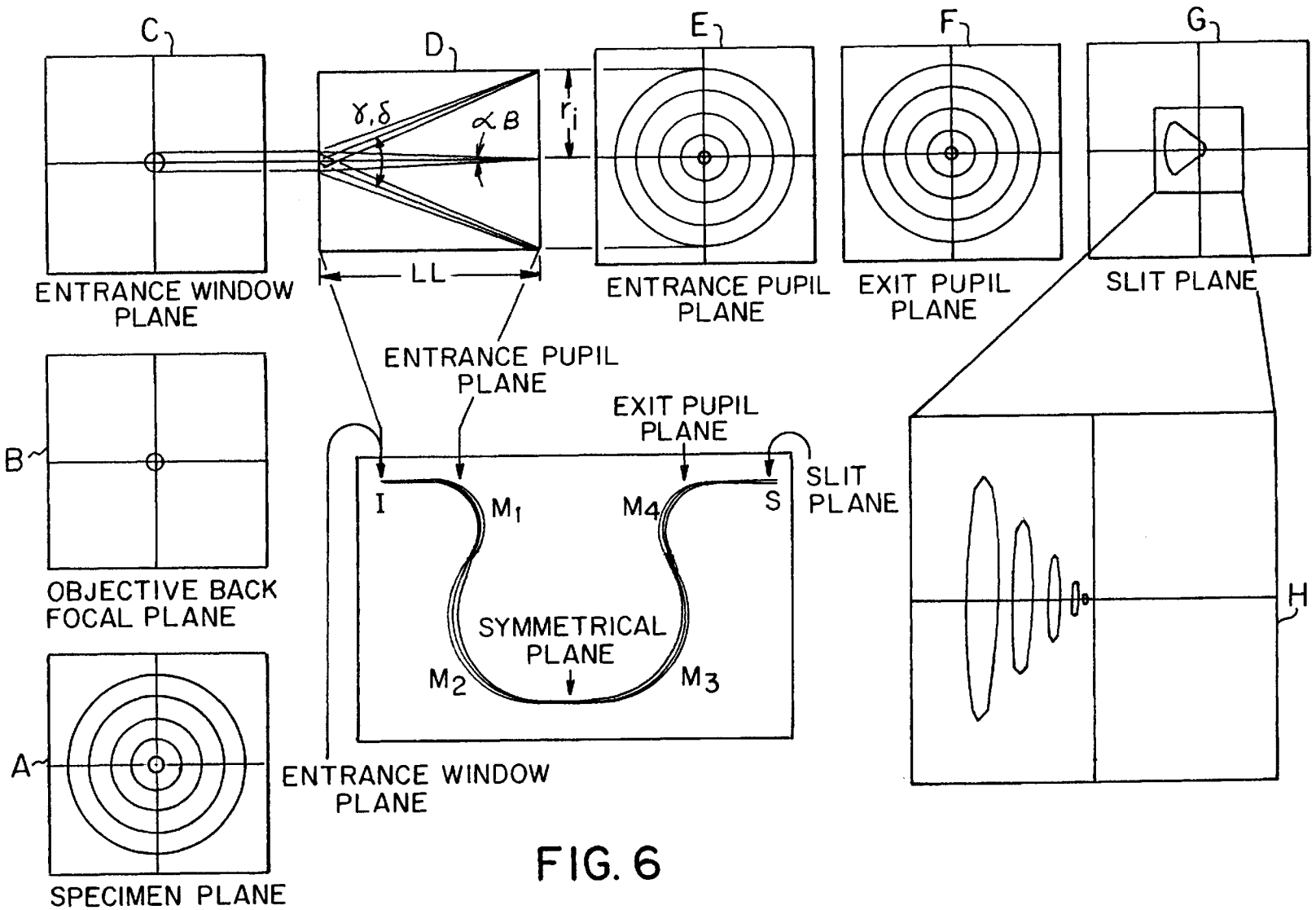
FIG. 6 illustrates geometrical figures on a specimen plane and the relation between the image on a pupil plane and of the electron beam on a split plane.
Figure 7:
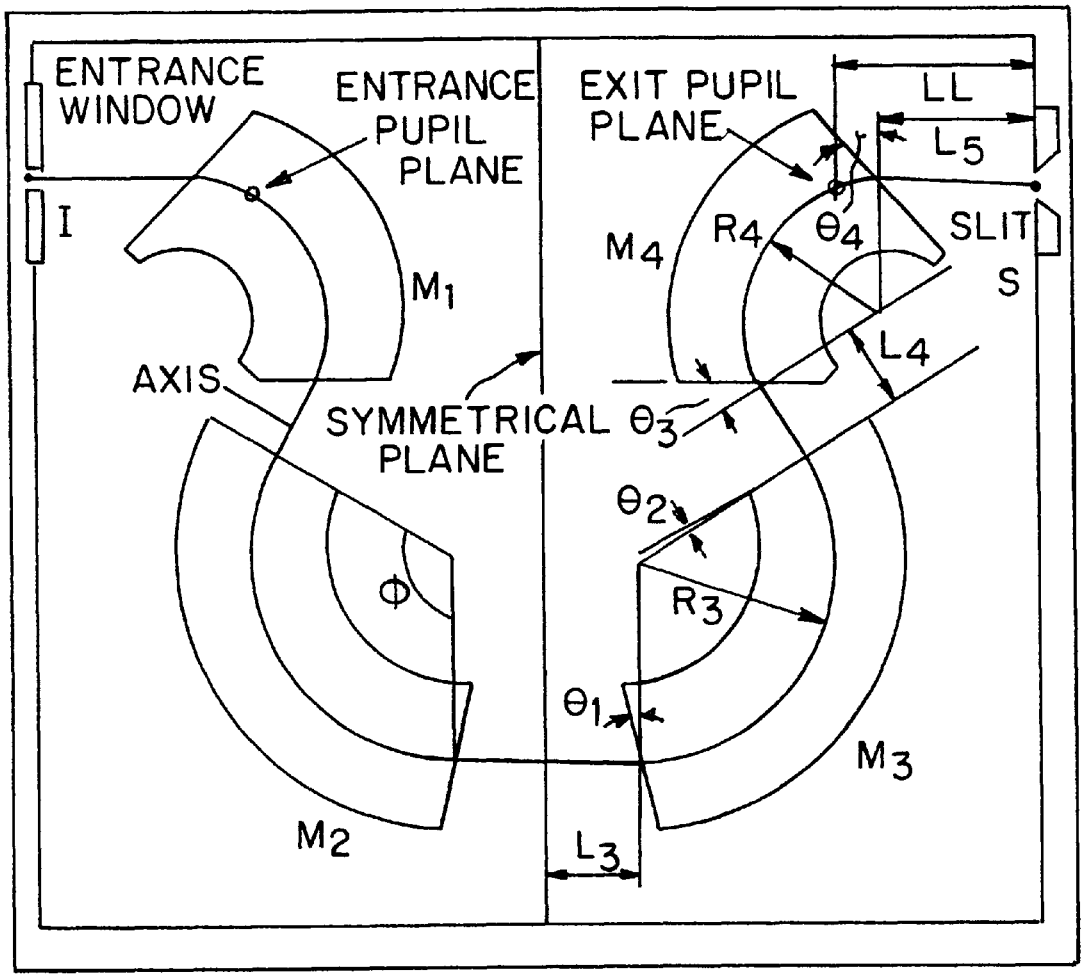
FIG. 7 is a diagram illustrating parameters used to design an omega-type energy filter.
Figure 8A:
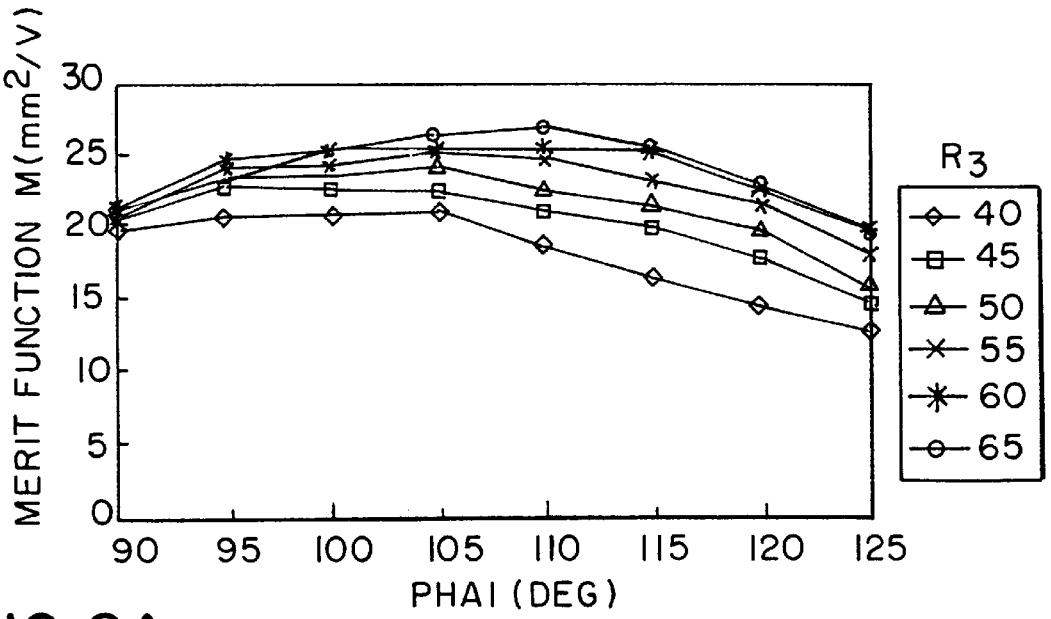
FIGS. 8A and 8B are diagrams illustrating the dependence of the merit function M on the deflection angle Φ.
Figure 8B:
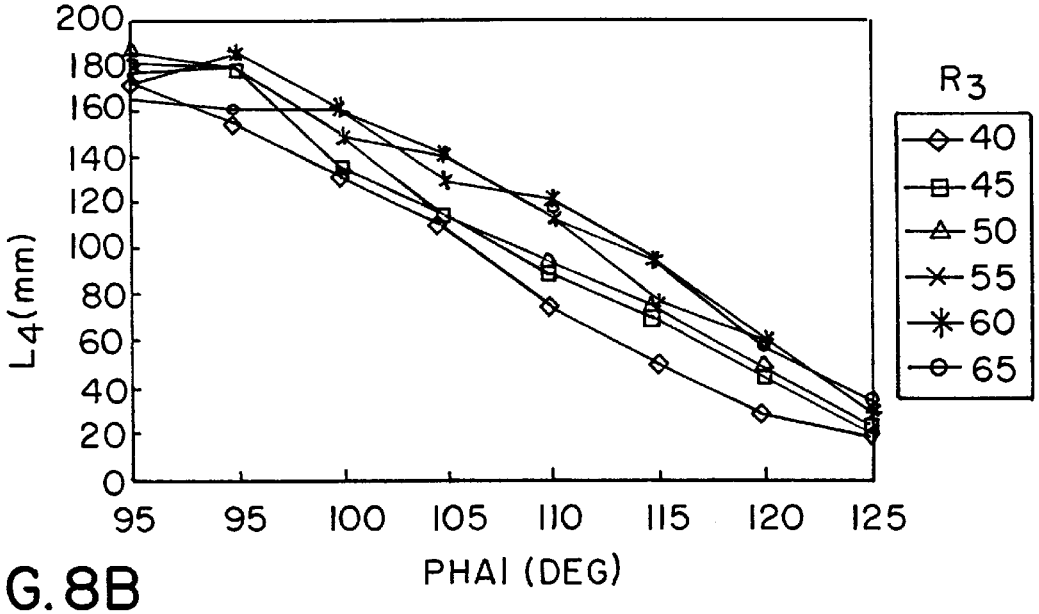
Figure 9C:
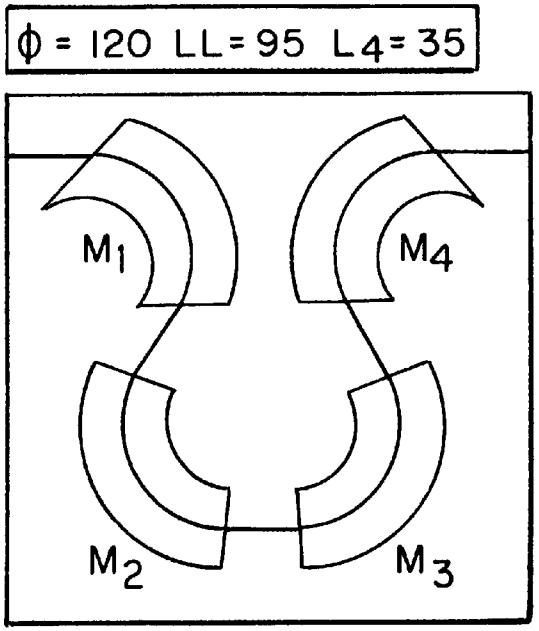
FIGS. 9A, 9B and 9C are diagrams illustrating the relation of the filter geometry to the deflection angle Φ.
Figure 9B:
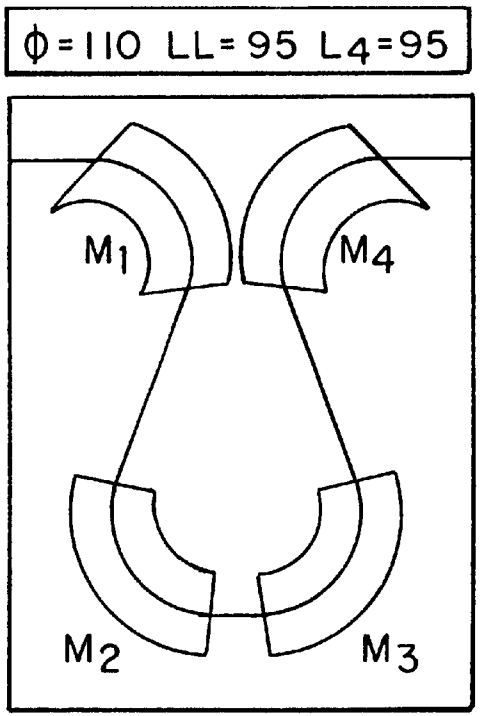
Figure 9A:
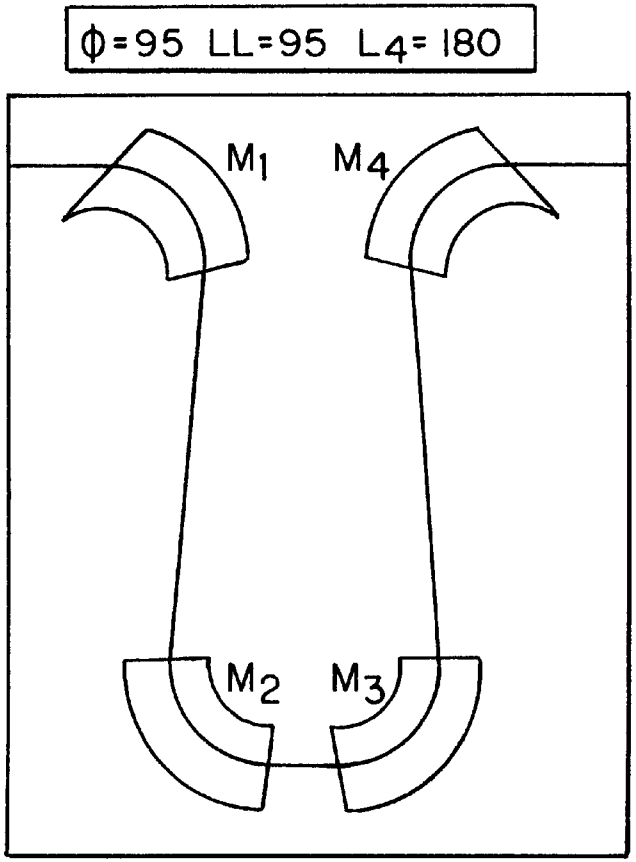

The omega-type energy filter is constructed as described previously. That is, it has four magnetic fields $M_1$, $M_2$, $M_3$, and $M_4$ produced in this order to deflect the electron beam into an Ω-shaped orbit. A symmetrical plane, or central plane, is located between the second field $M_2$ and the third field $M_3$. As shown in FIG. 7, the beam shows a radius of curvature of $R_3$ in the magnetic filed $M_3$ on the side of the symmetrical plane. The entrance end surface of the field $M_3$ is tilted at an angle of $\theta_1$. The exit end surface of the field $M_3$ is tilted at an angle of $\theta_2$. The beam exhibits a radius of curvature of $R_4$ in the magnetic filed $M_4$ on the side of the slit. The entrance end surface of the field $M_4$ is tilted at an angle of $\theta_4$. The exit end surface of the field $M_4$ is tilted at an angle of $\theta_4$. Their deflection angles are equal to Φ. Let $L_3$ be the distance, or drift length, from the symmetrical plane to the entrance end surface of the field $M_3$ on the side of the symmetrical plane. Let $L_4$ be the distance from the exit end surface of the field $M_3$ to the entrance end surface of the field $M_4$. Let $L_5$ be the distance from the exit end surface of the field $M_4$ on the side of the slit to the slit plane S. Let LL be the distance from the exit pupil plane to the slit plane.

A method of designing the instrument in such a way that it is minimally affected by slight deviations of calculated results from actual values and by inaccuracy of instrumental assembly is now discussed. It is first assumed than an electron beam leaving the magnetic field $M_1$ is deflected through an angle that is greater than the intended value by 1°. This deviation produces an incident position deviation of $L_4 \times \tan 1°$ on entering the magnetic field $M_2$. This in turn produces a greater magnetic path length in the magnetic field $M_2$. Consequently, the electron beam undergoes intenser deflection. The central beam cannot travel parallel to the incident beam between the fields $M_2$ and $M_3$. This unparallel movement upsets the symmetry about the symmetrical plane, thus inducing distortions and aberrations. In addition, other conditions deviate greatly from the intended conditions. The effects can be minimized by reducing the distance $L_4$.

Accordingly, for the above-described reason, the present invention introduces the fourth condition $$L_4 \le 50\sqrt{U^*} \,/\, \sqrt{U^*(200)} \text{ mm} \tag{4}$$

in addition to the above-described three conditions, i.e., $$0 \le \theta_1, \theta_2, \theta_3, \theta_4 \le 45° \text{ (excluding negative values)} \tag{1}$$

$$\text{dispersion } D \ge \sqrt{U^*} \,/\, \sqrt{U^*(200)} \ \mu\text{m/eV} \tag{2}$$

$$20\sqrt{U^*} \,/\, \sqrt{U^*(200)} \text{ mm} \le 2 \times L_3, L_4, L_5 \le 200\sqrt{U^*} \,/\, \sqrt{U^*(200)} \text{ mm} \tag{3}$$

In consequence, the width of the filter orthogonal to the incident and outgoing beams is reduced. That is, the lateral dimension of the filter decreases. Note that $L_4/R_4 \leqq 1$.

The relation of the merit function M to the deflection angle Φ where the instrument is optimized under the conditions described above is illustrated in FIG. 10. It can be seen that the merit function M assumes its maximum value when the deflection angle Φ is 120°, which differs from conditions anticipated heretofore. However, at 126° or more, solutions that satisfy the conditions (1)–(4) above have not been obtained. In this optimizing process, the other dimensions are optimized as follows.

The distance $L_3$ should be made as small as possible for the following reason. In many filters presently used in practical applications, a hexapole compensator or the like is inserted at this distance $L_3$ and this distance is set large. If errors produced during design and manufacture of the instrument can be reduced to a negligible level, then the insertion of the hexapole compensator is made unnecessary. However, the quadrupole field components of the end surfaces of the fields $M_2$ and $M_3$ are used to achieve focusing in a direction parallel to the fields. To secure their fringing fields, the condition $2L_3 \geqq 20\sqrt{U^*}/\sqrt{U^*(200)}$ mm is left. Consequently, the range $20\sqrt{U^*}/\sqrt{U^*(200)}$ mm $\geqq L_3$ $10\sqrt{U^*}/\sqrt{U^*(200)}$ mm in which no compensator can be inserted gives the optimum condition.

With respect to the distance $L_5$, increasing this distance increases the dispersion D, as shown in FIG. 11B. Conversely, reducing the distance $L_5$ tends to increase the merit function M, as shown in FIG. 11A. Accordingly, the distance $L_5$ is set at minimum as long as the condition (2) is met. The minimum value of the distance $L_5$ giving dispersion $D \geqq \sqrt{U^*}/\sqrt{U^*(200)}$ μm/eV is $30\sqrt{U^*}/\sqrt{U^*(200)}$ mm. The distance $L_5$ giving $M \geqq 15$ is $L_5 \leqq 50\sqrt{U^*}/\sqrt{U^*(200)}$. Therefore, the range is set to $30\sqrt{U^*}/\sqrt{U^*(200)}$ mm $\leqq L_5 \leqq 50\sqrt{U^*}/\sqrt{U^*(200)}$.

It may also be possible to determine the dimension such as the distance $L_4$ based on the radius of curvature $R_4$. The simulation described above was performed while maintaining the radius of curvature $R_4$ at 50 mm in an attempt to make the instrument more compact. If the radius of curvature $R_4$ is doubled to 100 mm, then the size of the whole instrument is doubled. Also, the merit function M doubles. Specifically, the dispersion D is doubled. The height $r_i$ of the image on the pupil plane is doubled. The aberration $\Delta X_s$ is increased by a factor equal to the second power of 2. The equation of the merit function $M = D\, r_i^2/\Delta X_s$ leads to the conclusion that M is doubled. In this way, the value of the merit function M varies in proportion to the radius of curvature $R_4$. However, the relations of the radius of curvature $R_4$ to other dimensions such as $R_3$ and $L_4$ should remain unchanged. In addition, the conclusion of an evaluation determining these dimensions should not change. For example, in FIG. 10, only the value of the vertical axis is doubled; neither the horizontal axis nor the shape of the graph varies. Therefore, the dimensions such as $L_4$ can be set, based on the radius of curvature $R_4$.

Conversely, if the radius of curvature $R_4$ is set to 50 mm, the compactness and the performance of the instrument are satisfactory in practical applications. If the radius of curvature $R_4$ is set less than 50 mm, the instrument is rendered more compact, but the performance may be unsatisfactory. If it were set greater than 50 mm, higher performance would be obtained. However, the instrument may not be sufficiently compact.

As can be understood from the description provided thus far in the present invention, the distance $L_4$ from the exit end surface of the third magnetic field $M_3$ to the entrance end surface of the fourth magnetic field $M_4$ is set no greater than $50\sqrt{U^*}/\sqrt{U^*(200)}$ mm or $R_4$. The deflection angle $\Phi$ is set to a range of from 120°−5° to 120°+5°. Consequently, the width of the filter perpendicular to the incident and outgoing beams can be reduced. Thus, the drift lengths can be shortened. As a result, the instrument can be made compact. Furthermore, deviations from the filter conditions found by calculations can be decreased. Moreover, the merit function can be increased.

Having thus described my invention with the detail and particularity required by the Patent Laws, what is desired protected by Letters Patent is set forth in the following claims.

What is claimed is:

1. An omega-type energy filter comprising:

an entrance window;

an exit window forming a slit plane;

a first magnetic field $M_1$, a second magnetic field $M_2$, a third magnetic field $M_3$, and a fourth magnetic field $M_4$ produced in this order to deflect an electron beam into an Ω-shaped orbit from said entrance window to said exit window;

said third magnetic field $M_3$ having an exit end surface;

said fourth magnetic field $M_4$ having an entrance end surface located a distance of $L_4$ from the exit end surface of said third magnetic field $M_3$;

said distance $L_4$ being set no greater than $50\sqrt{U^*}/\sqrt{U^*(200)}$ mm where $U^*$ is a relativistically modified accelerating voltage and $U^*(200)$ is a value obtained at 200 kV; and said magnetic fields having a deflection angle of from 120°−5° to 120°+5°.

2. The omega-type energy filter of claim 1, wherein a symmetrical plane exists between said second magnetic field $M_2$ and said third magnetic field $M_3$ and is located a distance of $L_3$ from an entrance end surface of said third magnetic field $M_3$, and wherein said distance $L_3$ is set such that $$20\sqrt{U^*}\,/\,\sqrt{U^*(200)}\ \text{mm} \geq L_3 \geq 10\sqrt{U^*}\,/\,\sqrt{U^*(200)}\ \text{mm}.$$

3. The omega-type energy filter of claim 1, wherein said fourth magnetic field $M_4$ has an exit end surface located a distance of $L_5$ from said exit window, and wherein said distance $L_5$ is set such that $$30\sqrt{U^*}\,/\,\sqrt{U^*(200)}\ \text{mm} \leq L_5 \leq 50\sqrt{U^*}\,/\,\sqrt{U^*(200)}\ \text{mm}.$$

4. An omega-type energy filter comprising:

an entrance window;

an exit window forming a slit plane;

a first magnetic field $M_1$, a second magnetic field $M_2$, a third magnetic field $M_3$, and a fourth magnetic field $M_4$ produced in this order to deflect an electron beam into an Ω-shaped orbit from said entrance window to said exit window;

said third magnetic field $M_3$ having an exit end surface;

said fourth magnetic field $M_4$ having an entrance end surface located a distance of $L_4$ from the exit end surface of said third magnetic field $M_3$;

said fourth magnetic field $M_4$ imparting a radius of curvature $R_4$ to said beam, said distance $L_4$ being no greater than said radius of curvature $R_4$; and said magnetic fields having a deflection angle of from 120°−5° to 120°+5°.

5. The omega-type energy filter of claim 4, wherein a symmetrical plane exists between said second magnetic field $M_2$ and said third magnetic field $M_3$ and is located a distance of $L_3$ from an entrance end surface of said third magnetic field $M_3$, and wherein said distance $L_3$ is set such that $2R_4/5 \geqq L_3 \geqq R_4/5$.

6. The omega-type energy filter of claim 4, wherein said fourth magnetic field $M_4$ has an exit end surface located a distance of $L_5$ from said exit window, and wherein said distance $L_5$ is set such that $3R_4/5 \leqq L_5 \leqq R_4$.

* * * * *

UNITED STATES PATENT AND TRADEMARK OFFICE

CERTIFICATE OF CORRECTION

PATENT NO. : 5,955,732

DATED : September 21, 1999

INVENTOR(S) : Katsushige Tsuno

It is certified that error appears in the above-identified patent and that said Letters Patent is hereby corrected as shown below:

Title Page, refer to [73] Assignee: "Jeol Ltd." should read --JEOL Ltd.--

Title Page, refer to [57] ABSTRACT, Line 12, "mm ≥ 10" should read --mm ≥ $L_3$ ≥ 10--.

Column 4 Line 20 "ΔXhd s=" should read --$\Delta X_s$ =--.

Column 7 Line 8 "and of" should read --and the shape of--.

Column 7 Line 13 "Φ," should read --Φ;--.

Column 7 Line 19 "a the distance" should read --among the distance--.

Column 7 Line 42 "$\theta_4$" should read --$\theta_3$--

Column 8 Line 39 "$L_3$ 10" should read --$L_3$ ≥ 10--.

Signed and Sealed this

Twenty-fifth Day of April, 2000

*Attest:*

*Attesting Officer*

Q. TODD DICKINSON

*Director of Patents and Trademarks*